US010270205B2

(12) United States Patent
Nishio et al.

(10) Patent No.: US 10,270,205 B2
(45) Date of Patent: Apr. 23, 2019

(54) LEVER-TYPE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shuya Nishio, Mie (JP); Junichi Mukuno, Mie (JP); Kiyokazu Sakaguchi, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 6 days.

(21) Appl. No.: 15/571,108

(22) PCT Filed: May 2, 2016

(86) PCT No.: PCT/JP2016/063540
§ 371 (c)(1),
(2) Date: Nov. 1, 2017

(87) PCT Pub. No.: WO2016/185904
PCT Pub. Date: Nov. 24, 2016

(65) Prior Publication Data

US 2018/0175549 A1 Jun. 21, 2018

(30) Foreign Application Priority Data

May 20, 2015 (JP) ..... 2015-102617

(51) Int. Cl.
*H01R 13/62* (2006.01)
*H01R 13/621* (2006.01)
*H01R 13/629* (2006.01)

(52) U.S. Cl.
CPC ... *H01R 13/6215* (2013.01); *H01R 13/62938* (2013.01); *H01R 13/62955* (2013.01)

(58) Field of Classification Search
CPC ..... H01R 13/6215; H01R 13/62938; H01R 13/62955
(Continued)

(56) References Cited

U.S. PATENT DOCUMENTS 5,711,682 A * 1/1998 Maejima ..... H01R 13/62933 439/157
7,083,471 B2 * 8/2006 Hayashi ..... H01R 13/5221 439/159
(Continued)

FOREIGN PATENT DOCUMENTS

JP 2004-273381 9/2004
JP 2005-11647 1/2005
(Continued)

OTHER PUBLICATIONS

International Search Report dated Jul. 26, 2016.

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

A lever-type connector (3) to be connected to a mating connector (2) and fixed to connector fixing portions (12) provided on the mating connector (2) includes a lever (19) to be operated in a state engaged with engaging portions (13) provided on the mating connector (2) and configured to connect a housing (20) to the mating connector (2) by a
(Continued)

boosting action exhibited by the operation thereof. With the lever (19) located at a connection position, a shield shell (21) and the lever (19) are fastened together to the connector fixing portions (12) by bolts.

3 Claims, 6 Drawing Sheets

(58) Field of Classification Search
USPC ..... 439/157, 372
See application file for complete search history.

(56) References Cited

U.S. PATENT DOCUMENTS

| | | | | |
|---|---|---|---|---|
| 7,794,247 | B2 * | 9/2010 | Suzuki | H01R 13/62955 439/157 |
| 7,811,105 | B1 * | 10/2010 | Tan Chin Yaw | H01R 13/6335 439/157 |
| 8,123,546 | B2 * | 2/2012 | Suzuki | H01R 13/62 439/157 |
| 9,325,112 | B2 * | 4/2016 | Tabata | H01R 13/62905 |
| 9,484,668 | B2 * | 11/2016 | Kamei | H01R 13/502 |
| 9,843,118 | B1 * | 12/2017 | Tanaka | H01R 12/82 |
| 2004/0266265 | A1 * | 12/2004 | Hayashi | H01R 13/5221 439/607.53 |
| 2011/0053408 | A1 | 3/2011 | Tsuruta et al. | |
| 2018/0069341 | A1 * | 3/2018 | Sakaguchi | H01R 13/5208 |

FOREIGN PATENT DOCUMENTS

| | | |
|---|---|---|
| JP | 2010-092614 | 4/2010 |
| JP | 2011-48949 | 3/2011 |

* cited by examiner

LEVER-TYPE CONNECTOR

BACKGROUND

Field of the Invention

The invention relates to a lever-type connector.

Description of the Related Art

Japanese Unexamined Patent Publication No. 2010-92614 discloses a connector that includes a lever to be rotated to assemble the connector with a mating connector. However, the connector has no structure to prevent the lever that has been rotated to a connection position (position where assembling with the mating connector is completed) from rotating in an opposite direction (counter connecting direction).

An object of this invention is to provide a simple configuration to prevent a lever at a connection position from rotating in a counter connecting direction.

SUMMARY

A lever-type connector disclosed in this specification is to be connected to a mating connector and is fixed by a bolt to a connector fixing portion provided on the mating connector. The lever-type connector includes a housing to be connected to the mating connector, a shield shell fixed to the housing and a lever provided on the housing or the shield shel. The shield shell is fixed to the connector fixing portion by inserting the bolt. The lever is operated in a state engaged with an engaging portion provided on the mating connector, and is configured to connect the housing to the mating connector by a boosting action exhibited by the operation of the lever. The shield shell and the lever are fastened together to the connector fixing portion by the bolt with the lever located at a connection position. Accordingly, since the shield shell and the lever are fastened together to the connector fixing portion with the lever located at the connection position. Thus, the rotation of the lever at the connection position in a counter connecting direction can be prevented by a simple configuration as compared to the case where there are separate configurations for fixing the connector to the connector fixing portion and for fixing the lever at the connection position.

The housing or the shield shell may be provided with a rotary shaft for the lever. The lever may include an arm formed with a bearing hole into which the rotary shaft is inserted, and a fixing portion may extend from a rotational end of the arm in a direction perpendicular to the arm. The fixing portion and the shield shell may be fastened together to the connector fixing portion, and the bearing hole may be a long hole making a distance between the fixing portion and the rotary shaft variable. Accordingly, even if there is something obstructing rotation on a rotational path of the fixing portion, a worker can avoid the obstruction and rotate the lever to the connection position by pulling the lever to make the distance between the fixing portion and the rotary shaft longer when rotating the lever to the connection position. After the lever is rotated to the connection position, the fixing portion can be brought into close contact with the shield shell by moving the fixing portion toward the rotary shaft. In that way, the lever can be fixed so as not to rattle.

The housing or the shield shell may be provided with a bearing hole. The lever may include an arm formed with a rotary shaft to be inserted into the bearing hole, and a fixing portion extending from a rotational end of the arm in a direction perpendicular to the arm. The fixing portion may be fastened together with the shield shell to the connector fixing portion, and the bearing hole may be a long hole making a distance between the fixing portion and the bearing hole variable. Accordingly can avoid something obstructing rotation on the rotational path of the fixing portion and can rotate the lever to the connection position by pulling the lever to make the distance between the fixing portion and the bearing hole longer when rotating the lever to the connection position. After the lever is rotated to the connection position, the fixing portion can be brought into close contact with the shield shell by moving the fixing portion toward the bearing hole. In that way, the lever can be fixed so as not to rattle.

According to the lever-type connector disclosed in this specification, the rotation of the lever at the connection position in the counter connecting direction can be prevented by a simple configuration.

DETAILED DESCRIPTION

An embodiment is described with reference to FIGS. 1 to 6. In the following description, a vertical direction and a lateral direction are based on a vertical direction and a lateral direction shown in FIG. 3 and a front-rear direction is based on a front-rear direction shown in FIG. 5.

Figure 1:
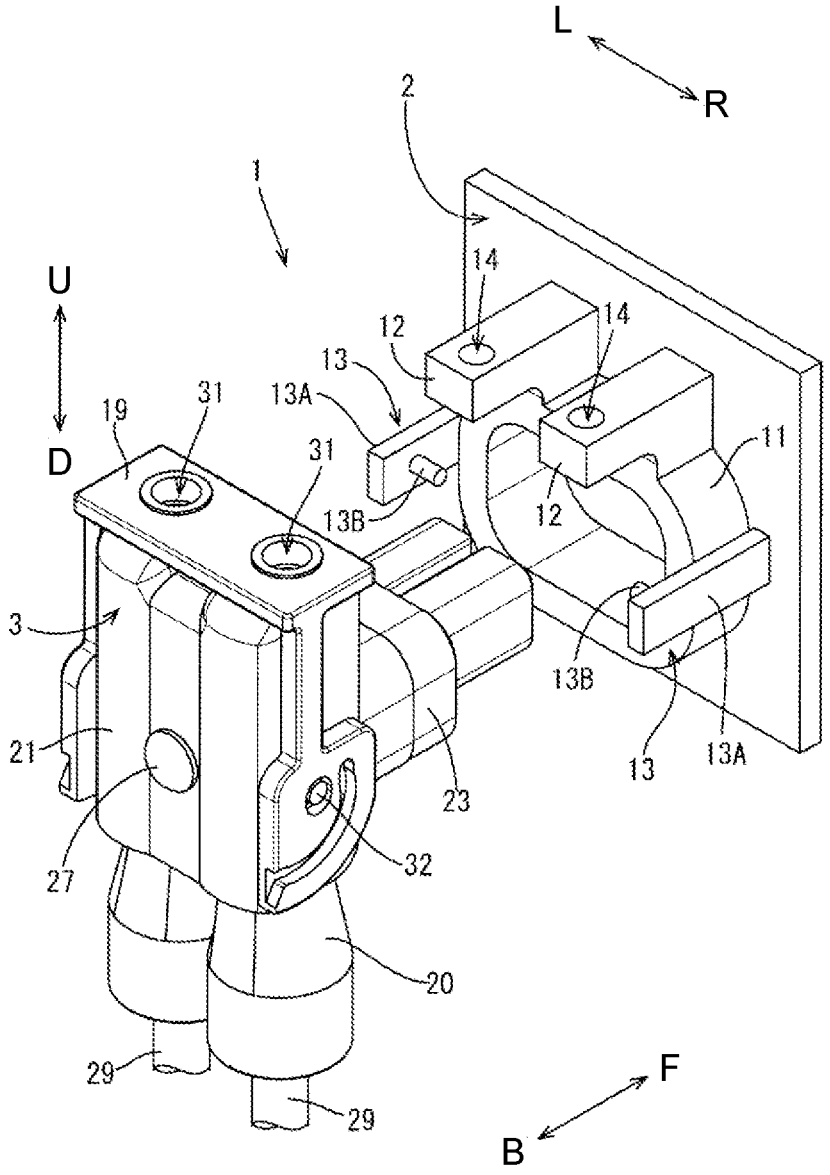
FIG. 1 is a perspective view of a connector connecting structure according to an embodiment.

As shown in FIG. 1, a connector connecting structure 1 according to this embodiment includes a shield structure 2 and a connector 3. The shield structure 2 is an example of a mating connector. Further, the connector 3 is an example of a lever-type connector.

(1) Shield Structure

The shield structure 2 is disposed in a shield case for covering an in-vehicle device such as an inverter or motor installed in a vehicle, such as a hybrid or electric vehicle. The shield structure 2 is formed of a conductive metal material and includes a mating-side fitting 11 in the form of a rectangular tube 11, two connector fixing portions 12 and two engaging portions 13.

The two connector fixing portions 12 are rectangular columns projecting rearward from an upper side of the mating-side fitting 11, and the tips thereof are located more rearward than the mating-side fitting 11. A bolt fastening hole 14 vertically penetrates a tip part of the connector fixing portion 12. Further, a lower part of the connector fixing portion 12 is integrated with the mating-side fitting 11.

The two engaging portions 13 include extending portions 13A extending rearward from both left and right sides of the mating-side fitting 11 and cylindrical cam pins 13B extending from tip parts of the extending portions 13A toward the other engaging portions 13.

(2) Connector

Figure 6:
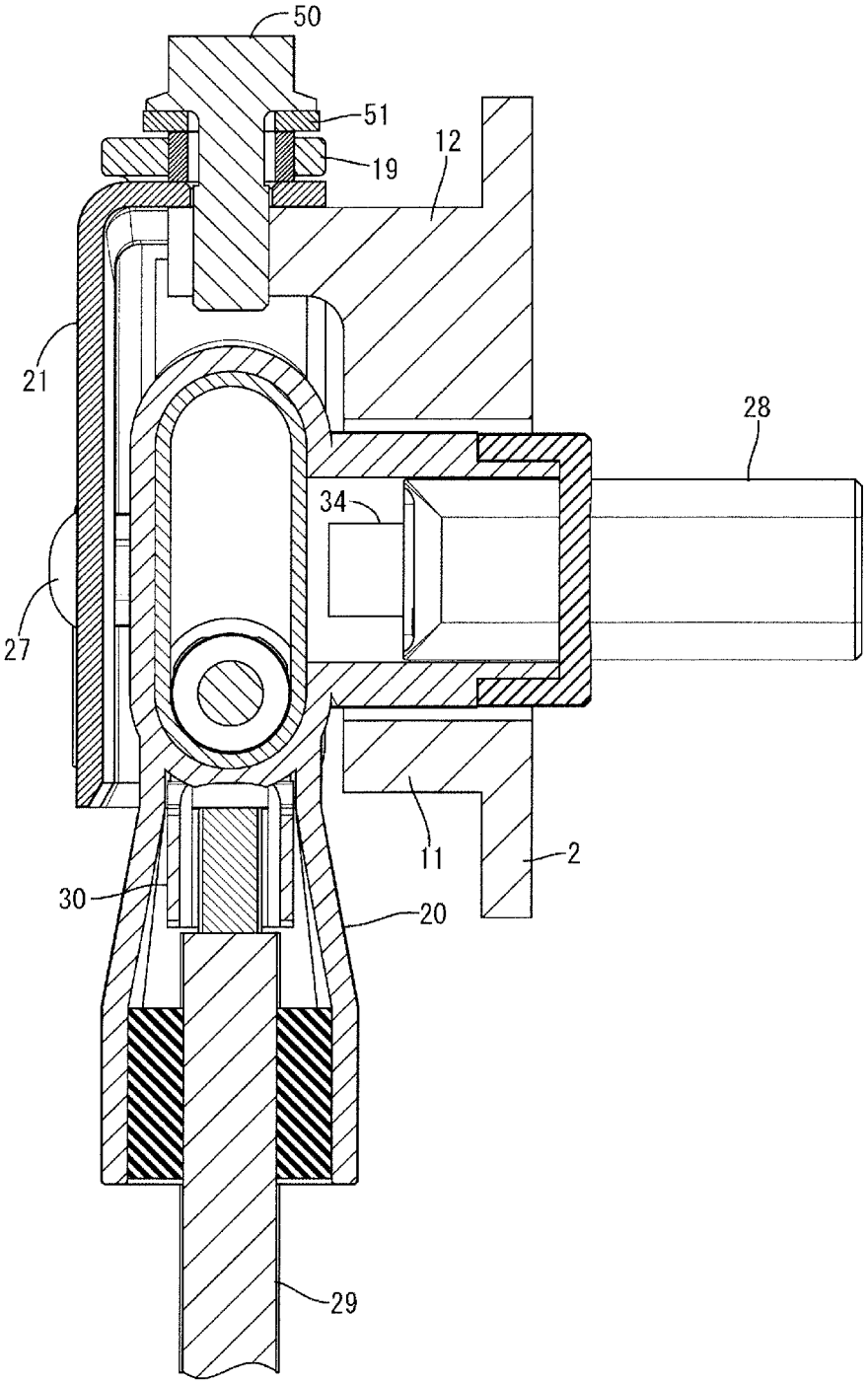
FIG. 6 is a section along A-A of FIG. 3.

The connector 3 is fit to the mating-side fitting 11 and fixed to the connector fixing portions 12 by bolts 50 (see FIG. 6). The connector 3 includes a housing 20, a shield shell 21 for covering the housing 20 and a lever 19 rotatably mounted on the shield shell 21. The housing 20 and the lever 19 are formed of synthetic resin and the shield shell 21 is formed of a conductive metal material.

Figure 2:
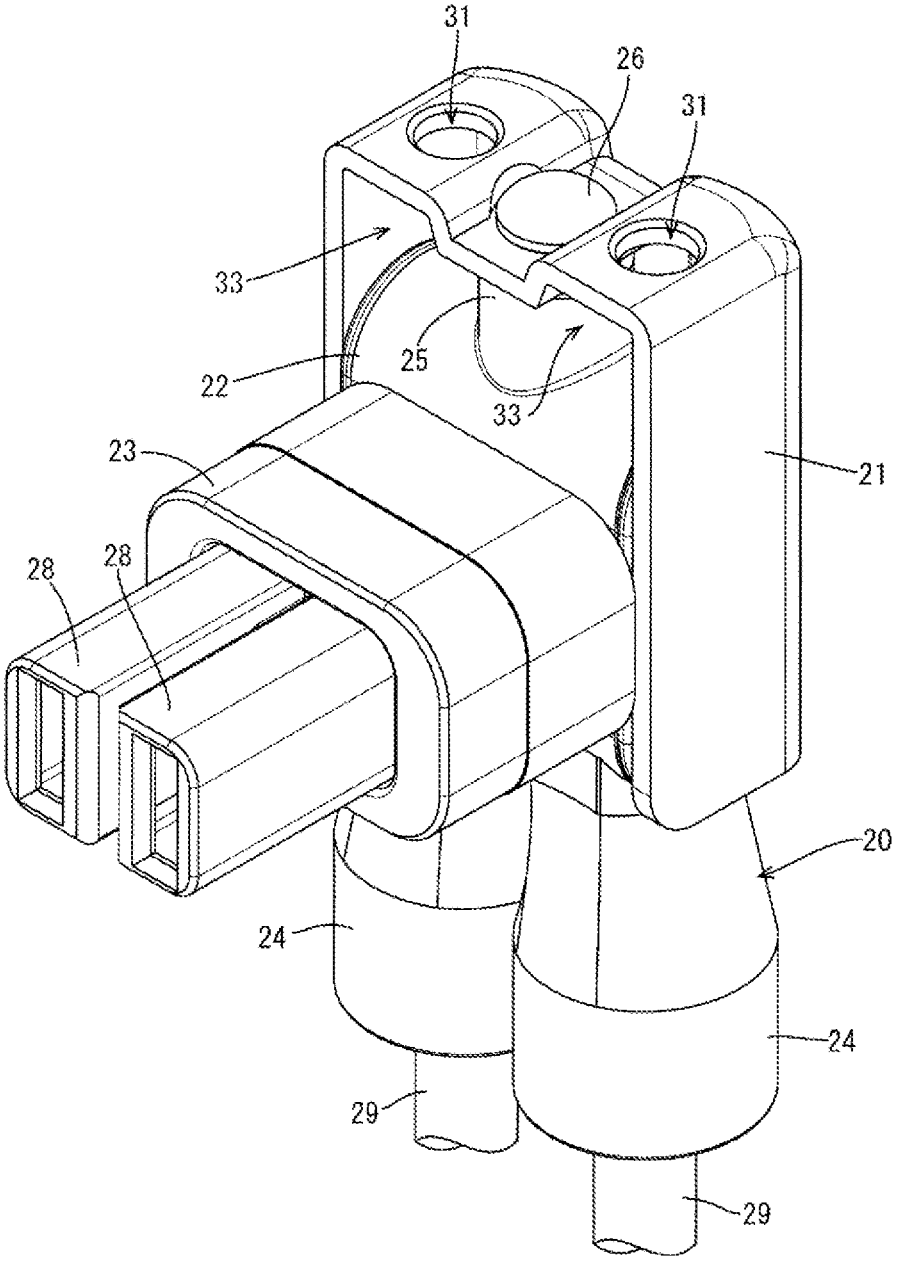
FIG. 2 is a perspective view of a connector with a lever and rotary shafts omitted when viewed from front.

As shown in FIG. 2, left and right spaces 33 are formed across a nut press-fit portion 25 to be described later between the upper wall of the shield shell 21 and the housing 20. The tip parts of the connector fixing portions 12 are inserted into these spaces 33.

(2-1) Housing

As shown in FIG. 2, the housing 20 includes a body 22, a connector-side fitting 23 and two wire pull-out portions 24, and is substantially L-shaped in a side view. Two conductive units are accommodated inside the housing 20. Each conductive unit includes a female terminal 34 (see FIG. 6), a wire 29 and a substantially L-shaped internal conductive member 30 (see FIG. 6) for electrically connecting the female terminal 34 and the wire 29. Note that the internal conductive member 30 is partially not shown in FIG. 6.

The body 22 is formed integrally with the nut press-fit portion 25 extending up. The nut press-fit portion 25 is formed with a bottomed hole, and an unillustrated nut is press-fit into this bottom hole from above. A bottomed hole also is formed on the rear surface of the body 22, and an unillustrated nut is press-fit into that hole. Bolts 26 and 27 (see FIG. 1) for fixing the shield shell 21 to the body 22 are fastened to these nuts.

The connector-side fitting 23 is a rectangular tube protruding forward from a front side of the body 22. The connector-side fitting 23 is fit and inserted into the mating-side fitting 11. Further, two terminal accommodating portions 28 are disposed in the connector-side fitting 23 to project forward. Each terminal accommodating portion 28 is a rectangular tube and the aforementioned female terminal 34 is accommodated inside.

The wire pull-out portion 24 includes a conical part conically expanding from the bottom of the body 22 and a hollow cylindrical part extending from the lower end of the conical part, and an upper end part of the wire 29 is accommodated inside.

(2-2) Shield Shell

As shown in FIG. 2, the shield shell 21 covers upper, left, right and rear sides of the body 22. In the shield shell 21, an upper wall covering the upper side of the body 22 and a rear wall covering the rear side are formed with through holes, and the shield shell 21 is fixed to the housing 20 by inserting the bolts 26, 27 (see FIG. 1) into those through holes.

The upper wall of the shield shell 21 is formed with two through holes 31 at positions above the bolt fastening holes 14 of the connector fixing portions 12 with the connector 3 connected to the shield structure 2. The bolts 50 for fastening the shield shell 21 and the lever 19 together to the connector fixing portions 12 are inserted through these through holes 31.

Further, as shown in FIG. 1, cylindrical rotary shafts 32 for the lever 19 project integrally on the outer surfaces of left and right side walls of the shield shell 21.

(2-3) Lever

Figure 3:
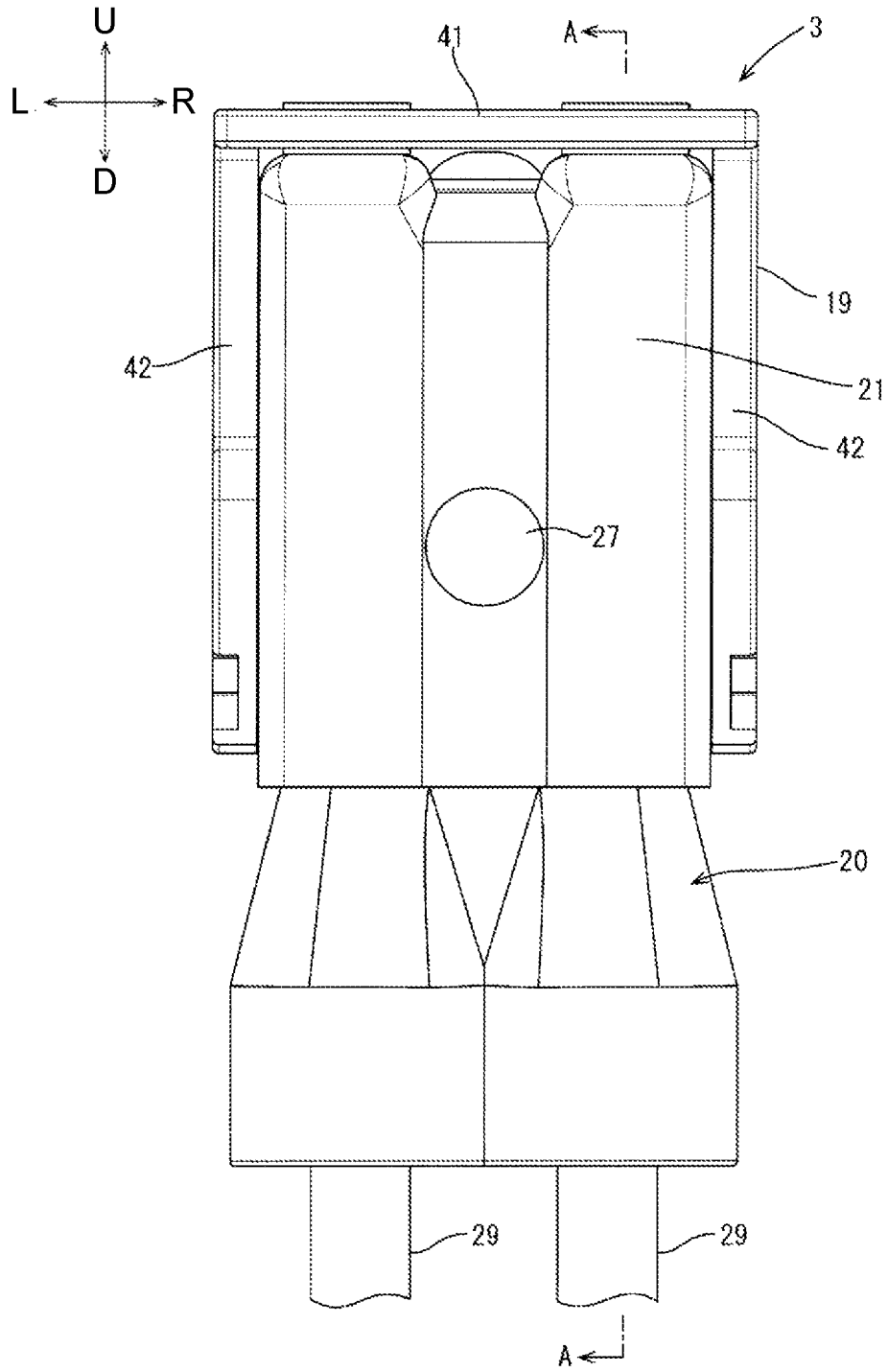
FIG. 3 is a front view of the connector when viewed from behind.
Figure 4:
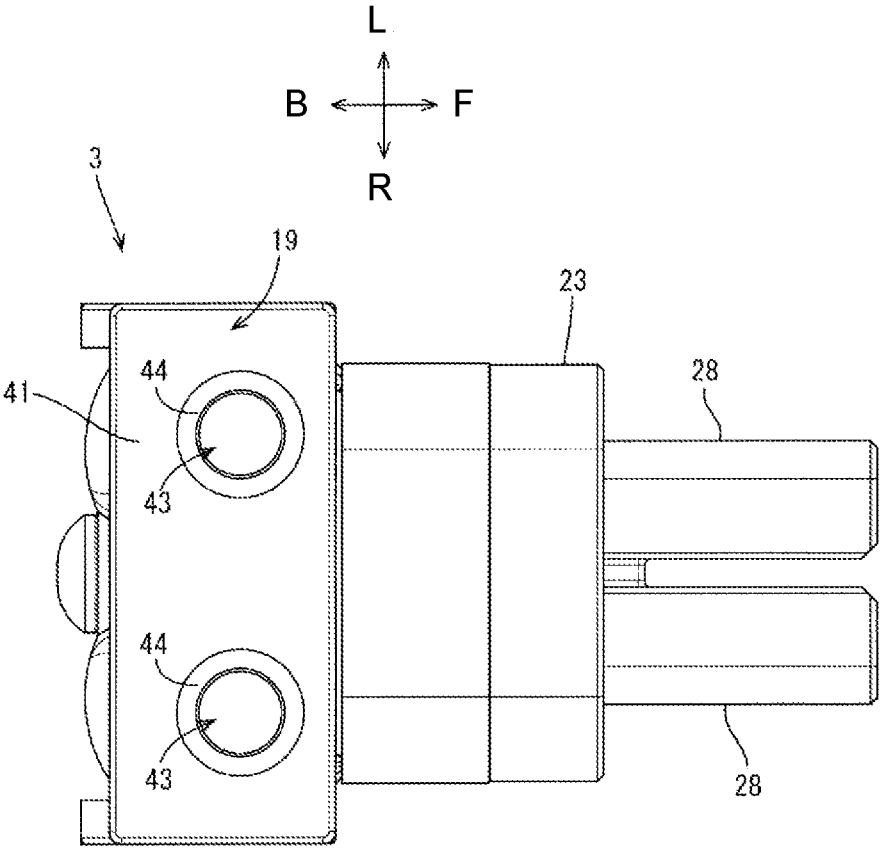
FIG. 4 is a top view of the connector.
Figure 5:
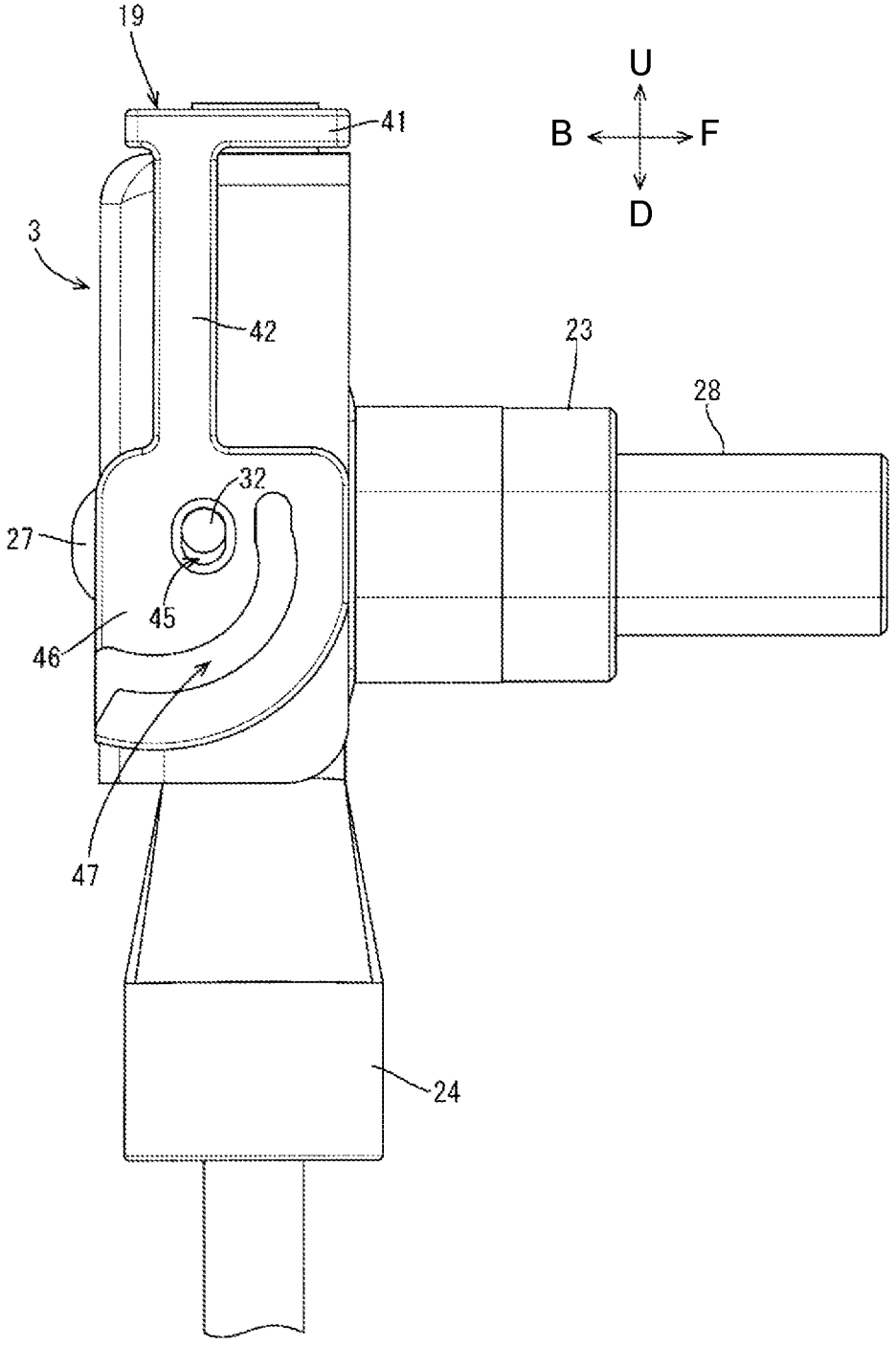
FIG. 5 is a side view of the connector

Next, the lever 19 is described with reference to FIGS. 3, 4 and 5. The lever 19 assists an operation of a worker to connect the housing 20 to the shield structure 2. FIGS. 3, 4 and 5 show the lever 19 at a connection position. The connection position is reached by rotating the lever 19 until the connector 3 is fit to the mating-side fitting portion 11.

As shown in FIG. 3, the lever 19 includes a fixing portion 41 located above the shield shell 21 at the connection position and two arms 42 extending down from both ends of the fixing portion 41 to form an inverted U-shape.

As shown in FIG. 4, the fixing portion 41 is a plate formed with through holes 43 at positions above the through holes 31 formed in the shield shell 21. The aforementioned bolts 50 are inserted through these through holes 43. A collar 44 made of metal for receiving an axial force of the bolt 50 is fit in the through hole 43 by insert molding or press-fitting.

As shown in FIG. 5, a bearing hole 45 is formed in a lower end part of the arm 42. The lever 19 is rotatably mounted on the shield shell 21 by inserting the rotary shafts 32 formed on the shield shell 21 into the bearing holes 45. The bearing hole 45 is a long hole and is oriented to be vertically long when the lever 19 is at the connection position.

A cam 46 is formed integrally in the lower end part of the arm 42. The cam 46 is formed with a cam groove 47 that engages the cam pin 13B provided on the shield structure 2. The profile of the cam groove 47 is set to gradually shorten a distance between the cam pin 13B and the rotary shaft 32 when the lever 19 is rotated in a connecting direction with the cam pin 13B engaged. In other words, the profile of the cam groove 47 is set such that the connector 3 gradually moves toward the mating-side fitting 11 when the lever 19 is rotated in the connecting direction with the cam pin 13B engaged.

A length of the arm 42 is longer than the distance between the cam pin 13B engaged with the cam groove 47 and the rotary shaft 32. Thus, when a worker rotates the lever 19 in the connecting direction, a boosting action is exhibited to amplify a force for moving the connector 3 toward the mating-side fitting 11. In this way, the worker can connect the connector 3 to the shield structure 2 with a small force.

(3) Connector Connecting Operation

In a connecting operation of the connector 3, the worker first sets the lever 19 at an initial position (position reached by rotating the lever 19 counterclockwise in FIG. 5) and aligns the connector 3 with the shield structure 2 in that state such that the entrances of the cam grooves 47 are located above the cam pins 13B.

When the worker rotates the lever 19 in the connecting direction (clockwise direction in FIG. 5) in that state, the cam pins 13B are engaged with the cam grooves 47. When the worker further rotates the lever 19 in the connecting direction, the connector 3 moves toward the mating-side fitting portion 11 by a cam action of the cam pins 13B and the cam grooves 47. When the lever 19 is rotated to the connection position, the fitting of the connector 3 to the mating-side fitting portion 11 is completed.

The worker rotates the lever 19 so that the fixing portion 41 does not hit a corner part of the shield shell 21 by pulling the lever 19 to make a distance between the fixing portion 41 and the rotary shafts 32 longer when rotating the lever 19 to the connection position. When the lever 19 is rotated to the connection position, the worker moves the fixing portion 41 toward the rotary shafts 32, thereby bringing the fixing portion 41 into close contact with the shield shell 21.

As shown in FIG. 6, when the connection of the connector 3 is completed, the worker fastens washers 51, the shield shell 21 and the lever 19 together to the connector fixing portions 12 by the bolts 50 to prevent rotation of the lever 19 in a counter connecting direction (counterclockwise direction in FIG. 5).

The shield shell 21 is fixed to the connector fixing portions 12 by the bolts 50 to ensure shield paths by electrically connecting the shield shell 21 and the shield structure 2 and improve vibration resistance of the connector 3 by preventing the connector 3 from vibrating a significant amount with respect to the shield structure 2.

(4) Effects of Embodiment

A configuration for moving over a projection (locking lance) provided on the housing 20 or the shield shell 21 when the lever 19 is rotated in the connecting direction, a configuration for fixing the connector 3 to the connector fixing portions 12 by bolts and fixing the lever 19 to the shield shell 21 using another bolt different from the former bolts, and the like are conceivable as a configuration for preventing the rotation of the lever 19 in the counter connecting direction. However, a configuration for fixing the connector 3 to the connector fixing portions 12 and a configuration for fixing the lever 19 at the connection position have to be provided separately in such cases and results in a complicated configuration.

In contrast, according to the connector 3, the shield shell 21 and the lever 19 are fastened together to the connector fixing portions 12 by the bolts 50 with the lever 19 located at the connection position. Thus, it is not necessary to provide a separate configuration for fixing the connector 3 to the connector fixing portions 12 and the configuration for fixing the lever 19 at the connection position. Therefore, the rotation of the lever at the connection position in the counter connecting direction can be prevented by a simple configuration.

The bearing holes are long holes oriented to be vertically long when the lever 19 is at the connection position. Thus, even if there is something obstructing rotation on a rotational path of the fixing portion 41 (corner part of the shield shell 21 in this embodiment), the worker can avoid the obstruction and rotate the lever 19 to the connection position by pulling the lever 19 to make the distance between the fixing portion 41 and the rotary shafts 32 longer when rotating the lever 19 to the connection position. After the lever 19 is rotated to the connection position, the fixing portion 41 can be brought into close contact with the shield shell 21 by moving the fixing portion 41 toward the rotary shafts 32. In that way, the lever 19 can be fixed so as not to rattle.

The invention is not limited to the above described and illustrated embodiment. For example, the following embodiments also are included in the scope of this invention.

A case where the lever 19 is rotatably mounted on the outer surfaces of the shield shell 21 is described as an example in the above embodiment. In contrast, the lever 19 may be rotatably mounted on inner surfaces of the shield shell 21 and extend outward from the inside of the shield shell 21.

The lever 19 to be rotated is described as an example in the above embodiment. In contrast, the lever 19 may be slid.

A case where the lever 19 is mounted on the shield shell 21 is described as an example in the above embodiment. In contrast, the lever 19 may be mounted on the housing 20.

A case where the lever 19 is provided with the cam grooves 47 and the shield structure 2 is provided with the cam pins 13B is described as an example in the above embodiment. Contrary to this, the lever 19 may be provided with a cam pin and the shield structure 2 may be provided with a cam groove. In that case, the cam groove is an example of the engaging portion.

A cam structure composed of the cam grooves 47 and the cam pin 13B is described as an example of a configuration for exhibiting a boosting action in the above embodiment. However, the configuration for exhibiting the boosting action is not limited to the cam structure and a configuration utilizing the principle of leverage or the like may be employed.

LIST OF REFERENCE SIGNS

1 . . . connector connecting structure
2 . . . shield structure (mating connector)
3 . . . connector (lever-type connector)
12 . . . connector fixing portion
13 . . . engaging portion
19 . . . lever
20 . . . housing
21 . . . shield shell
32 . . . rotary shaft
41 . . . fixing portion
42 . . . arm
45 . . . bearing hole
50 . . . bolt

The invention claimed is:

1. A lever-type connector to be connected to a mating connector and fixed to a connector fixing portion provided on the mating connector by a bolt, comprising:

a housing to be connected to the mating connector;

a shield shell fixed to the housing, the shield shell being fixed to the connector fixing portion by inserting the bolt; and a lever provided on the housing or the shield shell, operated in a state engaged with an engaging portion provided on the mating connector, and configured to connect the housing to the mating connector by a boosting action exhibited by the operation thereof, the shield shell and the lever being fastened together to the connector fixing portion by the bolt with the lever located at a connection position.

2. A lever-type connector according to claim 1, wherein:

the housing or the shield shell is provided with a rotary shaft for the lever;

the lever includes an arm portion formed with a bearing hole, into which the rotary shaft is inserted, and a fixing portion extending from a rotational end of the arm portion in a direction perpendicular to the arm portion, the fixing portion being fastened together with the shield shell to the connector fixing portion; and the bearing hole is formed into a long hole making a distance between the fixing portion and the rotary shaft variable.

3. A lever-type connector according to claim 1, wherein:

the housing or the shield shell is provided with a bearing hole;

the lever includes an arm portion formed with a rotary shaft to be inserted into the bearing hole, and a fixing portion extending from a rotational end of the arm portion in a direction perpendicular to the arm portion, the fixing portion being fastened together with the shield shell to the connector fixing portion; and the bearing hole is formed into a long hole making a distance between the fixing portion and the bearing hole variable.

* * * * *